US007478626B2

(12) United States Patent
Schürz

(10) Patent No.: US 7,478,626 B2
(45) Date of Patent: Jan. 20, 2009

(54) METHOD FOR PRODUCING AN INJECTOR

(75) Inventor: Willibald Schürz, Pielenhofen (DE)

(73) Assignee: Siemens Aktiengesellschaft, Munich (DE)

( * ) Notice: Subject to any disclaimer, the term of this patent is extended or adjusted under 35 U.S.C. 154(b) by 116 days.

(21) Appl. No.: 11/568,628

(22) PCT Filed: Feb. 25, 2005

(86) PCT No.: PCT/EP2005/050819

§ 371 (c)(1),
(2), (4) Date: Nov. 3, 2006

(87) PCT Pub. No.: WO2005/108772

PCT Pub. Date: Nov. 17, 2005

(65) Prior Publication Data

US 2008/0011885 A1 Jan. 17, 2008

(30) Foreign Application Priority Data

May 3, 2004 (DE) ..... 10 2004 021 652

(51) Int. Cl.
*F02D 41/24* (2006.01)

(52) U.S. Cl. ..... 123/490; 701/104; 29/890.12

(58) Field of Classification Search ..... 123/478, 123/480, 490; 701/103–105, 114–115; 29/890.12
See application file for complete search history.

(56) References Cited

U.S. PATENT DOCUMENTS

| | | | | |
|---|---|---|---|---|
| 5,115,982 | A | 5/1992 | Mesenich | 239/585.3 |
| 5,155,461 | A * | 10/1992 | Teerman et al. | 335/260 |
| 6,904,668 | B2 * | 6/2005 | Dallmeyer et al. | 29/602.1 |
| 7,162,355 | B2 * | 1/2007 | Yoda et al. | 701/104 |
| 2001/0002680 | A1 | 6/2001 | Kummer | 239/585.1 |

FOREIGN PATENT DOCUMENTS

| | | | |
|---|---|---|---|
| DE | 3834445 | A1 | 4/1990 |

(Continued)

OTHER PUBLICATIONS

International Search Report and Written Opinion for International Application No. PCT/EP2005/050819 (10 pages).

(Continued)

*Primary Examiner*—Hai H Huynh
(74) *Attorney, Agent, or Firm*—Baker Botts L.L.P.

(57) ABSTRACT

A first module (1) has an injector housing (4) and a lifting actuating drive. A second module (2) has a nozzle body (16), an injection needle (18), and a restoring means. At least one value of at least one characteristic number for the first module is determined by appropriate control of the lifting actuating drive, and the first module (1) is associated with a plurality of categories (CL) according to the at least one value of the at least one characteristic number. At least one value of at least one characteristic number for the second module (2) is determined by appropriate actuation of the injection needle (18), and the second module (2) is associated with one of the plurality of categories according to the at least one value of the at least one characteristic number. In each case, a first module (1) and a second module (2) of the same category are paired and mounted.

20 Claims, 4 Drawing Sheets

FOREIGN PATENT DOCUMENTS

| | | | |
|---|---|---|---|
| DE | 19534445 | C2 | 7/1998 |
| DE | 19939450 | A1 | 3/2001 |
| EP | 1245827 | A1 | 10/2002 |
| EP | 1245828 | A1 | 10/2002 |
| WO | 2004/106727 | A1 | 12/2004 |

OTHER PUBLICATIONS

German Office Action for German Application No. 10 2004 021 652.5 (4 pages).

* cited by examiner

METHOD FOR PRODUCING AN INJECTOR

CROSS-REFERENCE TO RELATED APPLICATIONS

This application is a U.S. national stage application of International Application No. PCT/EP2005/050819 filed Feb. 25, 2005 which designates the United States of America, and claims priority to German application number DE 10 2004 021 652.5 filed May 3, 2004, the contents of which are hereby incorporated by reference in their entirety.

TECHNICAL FIELD

The invention relates to a method for producing an injector, which is particularly appropriate for measuring fuel into a combustion chamber of a cylinder of an internal combustion engine.

BACKGROUND

Increasingly stringent legal provisions governing permitted pollutant emissions from internal combustion engines disposed in motor vehicles mean that various measures have to be taken to reduce pollutant emissions. One approach is to reduce the pollutant emissions produced by the internal combustion engine during the combustion of the air/fuel mixture directly. This means that it is important for the fuel to be measured in very precisely, requiring an injector that can be activated in a very precise manner. Injectors comprise a number of components, each having certain production scatter. An injector regularly comprises an injector housing and a lift actuating drive, configured for example as a piezoactuator, as well as a nozzle lock nut, a nozzle body and a nozzle needle, which is guided in a recess of the nozzle body and releases or closes an injection nozzle as a function of its position. A reset means is also regularly provided, to pre-tension the nozzle needle into its closed position.

SUMMARY

The object of the invention is to create a method for producing an injector, which makes it possible in a simple manner for the injector to be controlled precisely.

The object can be achieved by a method for producing an injector, comprising the steps of assembling a first module comprising an injector housing and a lift actuating drive, assembling a second module comprising a nozzle body, a nozzle needle and a reset means for the nozzle needle, determining at least one value of at least one characteristic variable for the first module by appropriate activation of the lift actuating drive, assigning the first module to one of a number of classes as a function of the at least one value of the at least one characteristic variable, determining at least one value of at least one characteristic variable for the second module by appropriate actuation of the nozzle needle, assigning the second module to one of a number of classes as a function of the at least one value of the at least one characteristic variable, and pairing and assembling a first module with a second module of the same class, respectively.

In an embodiment, a predetermined lift of the lift actuating drive can be set for the first module under the influence of a predetermined counter-force acting on the lift actuating drive and a variable, which is characteristic of the electrical energy that has to be supplied to the lift actuating drive for this purpose is determined as the characteristic variable. In an embodiment, a predetermined lift of the lift actuating drive can be set for the first module with a predetermined electrical energy being supplied and the counter-force required on the lift actuating drive for this purpose is determined as the characteristic variable. In an embodiment, at least one predetermined lift of the nozzle needle can be set for the second module with test fluid being supplied to the second module and a first characteristic variable can be determined as a function of the necessary force that has to be applied to act on the nozzle needle for this purpose. In an embodiment, the at least one predetermined lift of the nozzle needle can be set for the second module and a second characteristic variable can be determined as a function of a resulting throughflow of fluid through an injection nozzle of the nozzle body, with test fluid being supplied at a predetermined pressure. In an embodiment, at least one predetermined lift of the nozzle needle can be set for the second module and a predetermined throughflow of test fluid through the injection nozzle of the nozzle body can be set and a third characteristic variable can be determined as a function of the necessary pressure of the test fluid for this purpose.

BRIEF DESCRIPTION OF THE DRAWINGS

Exemplary embodiments of the invention are described below based on the schematic drawings, in which.

Elements with the same structure or function are shown with the same reference characters in all the figures.

DETAILED DESCRIPTION

Figure 1:
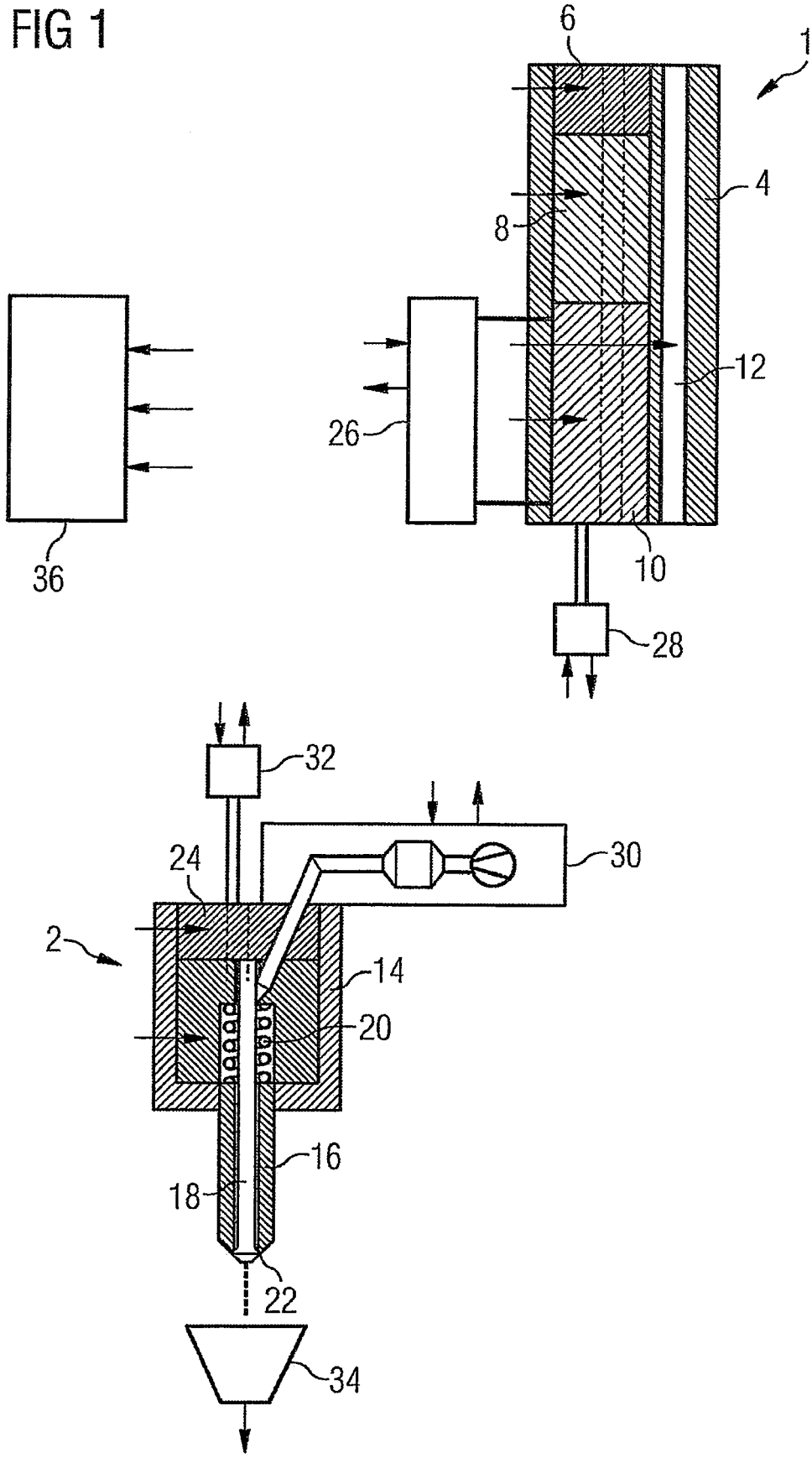
FIG. 1 shows a first and second module of an injector during the determination of at least one characteristic variable each for allocation to a class.
Figure 2:
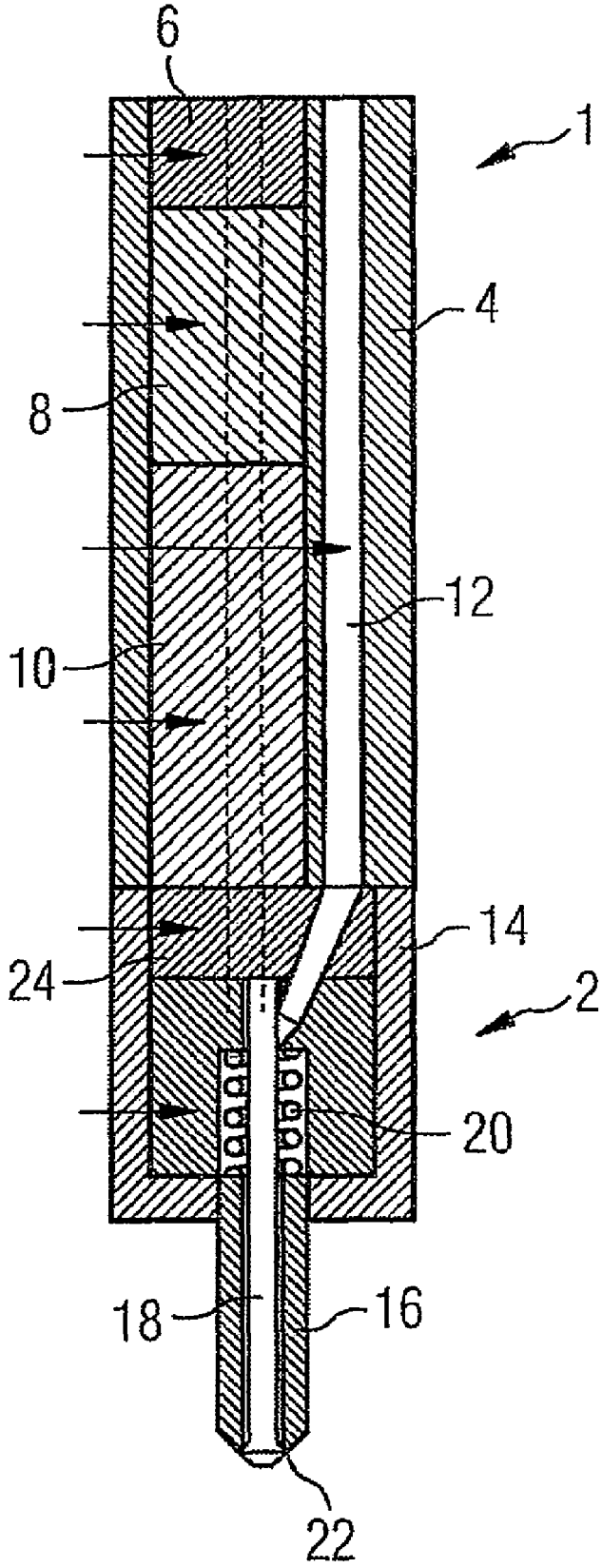
FIG. 2 shows the finished injector.

In an embodiment of a method for producing an injector, a first module comprising an injector housing and a lift actuating drive is mounted and a second module comprising a valve body, a nozzle needle and a reset means for the nozzle needle is mounted. At least one value of at least one characteristic variable is also determined for the first module by appropriate activation of the actuating drive. The first module is assigned to one or more classes as a function of the at least one value of the at least one characteristic variable. At least one value of at least one characteristic variable is determined for the second module by appropriate actuation of the nozzle needle. The second module is assigned to one or more classes as a function of the at least one value of the at least one characteristic variable. A first module is paired and mounted with a second module of the same class.

There is therefore no need to adjust the injector and adjustment elements that may otherwise be needed for this purpose can be dispensed with. It is also possible in a simple manner to ensure a low rejection rate during injector production. Also the first module is not exposed to a test fluid during determination of the characteristic variables, to which test fluid the second module is generally exposed during determination of the at least one value of its at least one characteristic variable. Such a test fluid has the disadvantage that it can in some instances damage the lift actuating drive, if this is not integrated in the injector housing in a hermetically sealed manner. This is particularly critical in respect of a lift actuating drive configured as a piezoactuator, which is cast using a silicon casting compound, which in some instances swells on contact with a test fluid, which is a fuel for example.

In one embodiment of the invention a predetermined lift of the lift actuating drive can be set for the first module under the influence of a predetermined counter-force on the lift actuating drive and a variable, which is characteristic of the electrical energy that has to be supplied to the lift actuating drive for this purpose is determined as the characteristic variable. The variable that is characteristic of the electrical energy that has to be supplied to the lift actuating drive for this purpose characterizes the individual activation response of the first module very effectively and is simple to acquire or determine.

In a further embodiment of the invention a predetermined lift of the lift actuating drive can be set for the first module with a predetermined electrical energy being supplied and the counter-force on the lift actuating drive required for this purpose is determined as the characteristic variable. This counter-force on the lift actuating drive required for this purpose also characterizes the individual activation response of the first module very effectively.

In a further embodiment of the invention at least one predetermined lift of the nozzle needle can be set for the second module with a test fluid being supplied to the second module and a first characteristic variable can be determined as a function of the necessary force that has to be applied to act on the nozzle needle for this purpose. The necessary force that has to be applied to act on the nozzle needle for this purpose characterizes the individual rigidity of the reset means of the second module very effectively.

According to a further embodiment of the invention the at least one predetermined lift of the nozzle needle can be set for the second module and a second characteristic value can be determined as a function of a throughflow of fluid then resulting through an injection nozzle of the valve body with test fluid being supplied at a predetermined pressure. The resulting throughflow characterizes the individual geometry of the second module very effectively. It is also simple to set the predetermined lift of the nozzle needle and to supply test fluid at the predetermined pressure.

According to a further embodiment of the invention at least one predetermined lift of the nozzle needle can be set for the second module and a predetermined throughflow of test fluid through the injection nozzle of the nozzle body can be set and a third characteristic variable can be determined as a function of the necessary pressure of the test fluid for this purpose. The pressure of the necessary test fluid for this purpose characterizes the individual geometry of the second module very effectively.

FIG. 1 shows a first module 1 and a second module 2 of an injector during production of the injector and during determination of the characteristic variables to classify the first and second modules.

The first module 1 comprises an injector housing 4, having a recess extending in an axial direction, in which a thrust bearing 6 is preferably compressed. Axially adjacent to this is a hydraulic equalizing element 8 and adjacent to this a lift actuating drive configured as a piezoactuator 10. A high-pressure hole 12 is also provided, which is provided to convey fuel from a fuel connection (not shown) to an injection nozzle 22 of the injector.

The second module comprises a nozzle lock nut 14, into which a nozzle body is inserted. The nozzle body 16 has a recess, into which a nozzle needle 18 is inserted. A reset means 20 is also provided, preferably configured as a spring, which pre-tensions the nozzle needle 18 into a closed position, in which it prevents the flow of fuel through the injection nozzle 22. A transmission element 24 is also provided, which is configured to transmit the lift of the piezoactuator 10. The transmission element 24 can alternatively also be disposed in the first unit or not be present at all.

A first unit 26 is provided, which is connected in an electrically conductive manner to the piezoactuator 10 and by way of which a predeterminable electrical energy can be supplied to the piezoactuator 10.

A second unit 28 is also provided, by way of which a counter-force against the piezoactuator 10 can be set or even determined.

A fourth unit 32 is also provided, by way of which a nozzle needle lift of the nozzle needle 18 can be set or even determined. A third unit 30 is also provided, by means of which the second module can be subjected to a test fluid, the third unit being configured to set a predetermined pressure of the test fluid or to determine the pressure of the test fluid. A fifth unit 34 is also provided, to receive the test fluid exiting from the injection nozzle 22, thereby determining the throughflow of test fluid through the injection nozzle needle.

An evaluation unit 36 is also provided, which is configured to assign the first and second modules 1, 2 respectively to one class CL of several classes CL respectively. Three classes CL can for example be provided but another number of classes CL can also be provided. The classes CL are selected such that injectors, which are made up in each instance of a first module and a second module of the same class, correspond very closely to a predetermined activation response and therefore ensure the precise measuring in of fuel.

Figure 3:
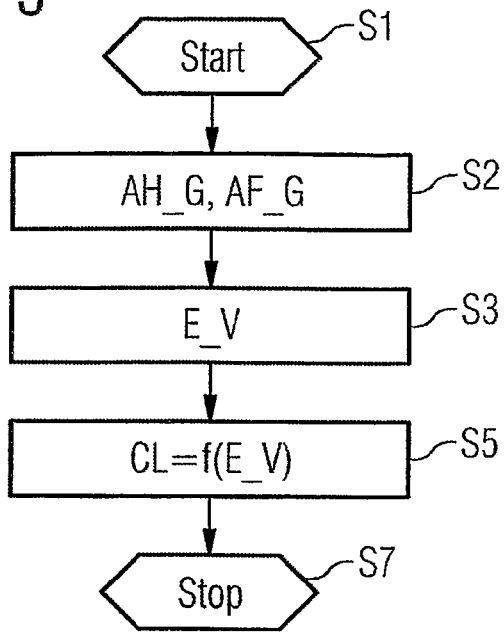
FIG. 3 shows a flow diagram of a program for determining a class of the first module.

A program for determining the class CL of the first module 1 is started in a step S1 (FIG. 3).

In a step S2 a predetermined lift AH_G of the piezoactuator is set under the influence of a predetermined counter-force AF_G on the piezoactuator 10. This is done using the first and second units 26, 28. The predetermined lift AH_G can for example be 40 μm. The predetermined counter-force AF_G can for example be 100 N in respect of the state of the piezoactuator 10, in which it is not deflected.

In a step S3 the electrical energy E_V, which was required to set the predetermined lift AH_G with the counter-force AF_G acting on the piezoactuator 10 at the same time, is determined. Steps S2 and S3 can also be repeated and a corresponding mean value of the required electrical energy E_V can thus be determined.

In a step S5 a class CL is assigned to the first module 1 as a function of the required energy E_V determined in step S3. Three classes are provided for example, such that either the first, second or third class is assigned in step S5 as a function of the respective value of the required electrical energy E_V. The program is then terminated in a step S7.

As an alternative to the procedure according to the program in FIG. 3, a predetermined electrical energy can also be supplied to the first module 1 and the predetermined lift AH_G can be set and it can then be determined what value the counter-force required on the lift actuating drive for this purpose must have. The class of the first module 1 is then also determined correspondingly as a function of the required counter-force.

Figure 4:
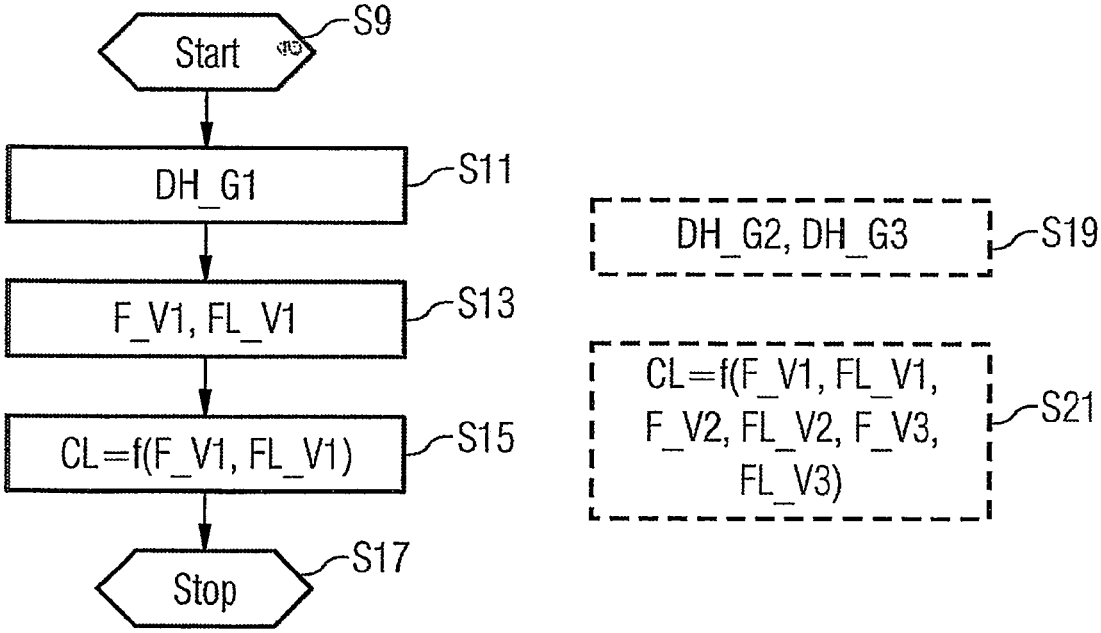
FIG. 4 shows a first embodiment of a program for determining the class of the second module and FIG. 5 shows a program of a second exemplary embodiment for determining the class of the second module.

A program (FIG. 4) for determining the class CL of the second module 2 is started in a step S9. In a step S11 the third unit 30 sets a predetermined pressure of the test fluid and a first predetermined lift DH_G1 of the nozzle needle 18 in the second module 2. In a step S13 the necessary first force F_V1 required for this purpose and the resulting first throughflow FL_V1 of test fluid through the injection nozzle 22 are then determined. The necessary first force F_V1 is determined in the fourth unit 32. The first throughflow FL_V1 of test fluid is determined in the fifth unit 34. It is possible for steps S11 and S13 to be repeated here too, with corresponding mean values being determined.

In a step S15 the class CL of the second module is determined as a function of the necessary first force F_V1 and the first throughflow FL_V1 of test fluid. Alternatively the class can also be determined solely as a function of the necessary first force F_V1 or alternatively the first throughflow FL_V1. The program is then terminated in a step S17.

A step S19 is also preferably provided, in which a further second predetermined lift DH_G2 of the nozzle needle 18 is set and a corresponding second necessary force F_V2 and a corresponding second throughflow FL_V1 of test fluid are acquired or determined and optionally also a further third predetermined lift DH_G3 of the nozzle needle 18 is set and then a corresponding third necessary force F_V3 and a corresponding third necessary throughflow FL_V3 of test fluid are determined. The class CL of the second module is then determined in a step S21 as a function of the necessary first to third forces F_V1 to F_V3 and/or the first to third throughflows FL_V1 to FL_V3 of test fluid.

Figure 5:
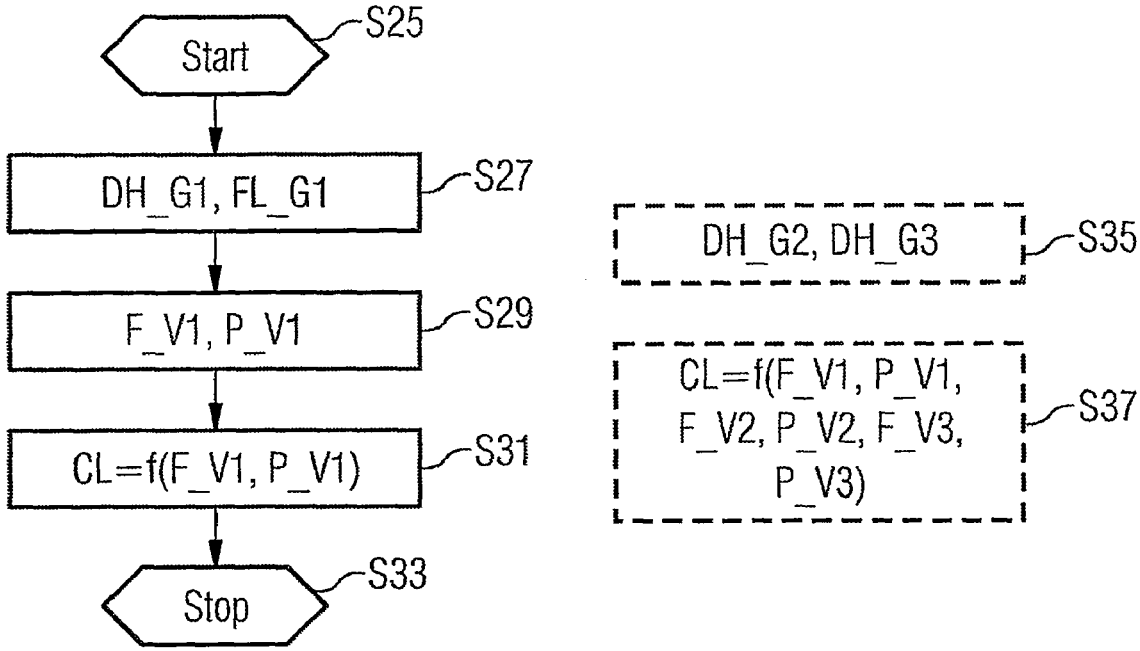

FIG. 5 shows a second embodiment of the program for determining the class CL of the second module 2. In contrast to the program according to FIG. 4, the program is started in a step S25 and in a step S27 a first predetermined lift DH_G1 of the nozzle needle 18 and a predetermined first throughflow FL_G1 of test fluid through the injection nozzle are set. In a subsequent step S29 the necessary first force for this purpose F_V1 and the necessary first pressure for this purpose P_V1 are determined or acquired, in the fourth unit 32 and the third unit 30. The steps S27 and S29 can be repeated here too, with corresponding mean values being determined in step S29.

In a step S31 a class CL is then assigned to the second module 2, as a function of the necessary first force F_V1 and/or the necessary first pressure P_V1. The program is then terminated in a step S31. In a step S35 the predetermined second lift DH_G2 of the nozzle needle 18 is then also preferably set and then the correspondingly necessary second force F_V2 and a correspondingly necessary second pressure P_V2 are determined. The third predetermined lift DH_G3 of the nozzle needle 18 is also preferably set and the necessary third force for this purpose F_V3 is acquired or determined and the necessary pressure for this purpose P_V3 is acquired or determined.

The class CL is then assigned to the second module 2 in a step S37 as a function of the necessary first to third force F_V1 to F_V3 and/or the necessary first to third pressure for this P_V1 to P_V3.

After carrying out the programs, first and second modules 1, 2 of the same class CL are then paired and program-controlled and for example mounted onto each other by program-controlled tightening of the nozzle lock nuts.

What is claimed is:

1. A method for producing an injector, comprising the steps of:

assembling a first module comprising an injector housing and a lift actuating drive, assembling a second module comprising a nozzle body, a nozzle needle and a reset means for the nozzle needle, determining at least one value of at least one characteristic variable for the first module by appropriate activation of the lift actuating drive, assigning the first module to one of a number of classes as a function of the at least one value of the at least one characteristic variable, determining at least one value of at least one characteristic variable for the second module by appropriate actuation of the nozzle needle, assigning the second module to one of a number of classes as a function of the at least one value of the at least one characteristic variable, and pairing and assembling a first module with a second module of the same class, respectively, wherein a predetermined lift of the lift actuating drive is set for the first module under the influence of a predetermined counterforce acting on the lift actuating drive and a variable, which is characteristic of the electrical energy that has to be supplied to the lift actuating drive for this purpose is determined as the characteristic variable.

2. The method as claimed in claim 1, wherein at least one predetermined lift of the nozzle needle is set for the second module with test fluid being supplied to the second module and a first characteristic variable is determined as a function of the necessary force that has to be applied to act on the nozzle needle for this purpose.

3. The method as claimed in claim 1, wherein the at least one predetermined lift of the nozzle needle is set for the second module and a second characteristic variable is determined as a function of a resulting throughflow of fluid through an injection nozzle of the nozzle body, with test fluid being supplied at a predetermined pressure.

4. The method as claimed in claim 1, wherein at least one predetermined lift of the nozzle needle is set for the second module and a predetermined throughflow of test fluid through the injection nozzle of the nozzle body is set and a third characteristic variable is determined as a function of the necessary pressure of the test fluid for this purpose.

5. The method as claimed in claim 1, wherein at least one predetermined lift of the nozzle needle is set for the second module with test fluid being supplied to the second module and a first characteristic variable is determined as a function of the necessary force that has to be applied to act on the nozzle needle for this purpose.

6. The method as claimed in claim 1, wherein the at least one predetermined lift of the nozzle needle is set for the second module and a second characteristic variable is determined as a function of a resulting through flow of fluid through an injection nozzle of the nozzle body, with test fluid being supplied at a predetermined pressure.

7. The method as claimed in claim 1, wherein at least one predetermined lift of the nozzle needle is set for the second module and a predetermined throughflow of test fluid through the injection nozzle of the nozzle body is set and a third characteristic variable is determined as a function of the necessary pressure of the test fluid for this purpose.

8. A method for producing an injector, comprising the steps of:

assembling a first module comprising a lift actuating drive, assembling a second module comprising a nozzle arrangement, determining at least one value of at least one characteristic variable for the first module by appropriate activation of the lift actuating drive, assigning the first module to one of a number of classes as a function of the at least one value of the at least one characteristic variable, determining at least one value of at least one characteristic variable for the second module by appropriate actuation of the nozzle arrangement, assigning the second module to one of a number of classes as a function of the at least one value of the at least one characteristic variable, and pairing and assembling a first module with a second module of the same class, respectively, wherein a predetermined lift of the lift actuating drive is set for the first module under the influence of a predetermined counter-force acting on the lift actuating drive and a variable, which is characteristic of the electrical energy that has to be supplied to the lift actuating drive for this purpose is determined as the characteristic variable.

9. The method as claimed in claim 8, wherein the nozzle arrangement comprises a nozzle body, a nozzle needle and a reset means for the nozzle needle.

10. The method as claimed in claim 9, wherein at least one predetermined lift of the nozzle needle is set for the second module with test fluid being supplied to the second module and a first characteristic variable is determined as a function of the necessary force that has to be applied to act on the nozzle needle for this purpose.

11. The method as claimed in claim 9, wherein the at least one predetermined lift of the nozzle needle is set for the second module and a second characteristic variable is determined as a function of a resulting throughflow of fluid through an injection nozzle of the nozzle body, with test fluid being supplied at a predetermined pressure.

12. The method as claimed in claim 9, wherein at least one predetermined lift of the nozzle needle is set for the second module and a predetermined throughflow of test fluid through the injection nozzle of the nozzle body is set and a third characteristic variable is determined as a function of the necessary pressure of the test fluid for this purpose.

13. The method as claimed in claim 9, wherein at least one predetermined lift of the nozzle needle is set for the second module with test fluid being supplied to the second module and a first characteristic variable is determined as a function of the necessary force that has to be applied to act on the nozzle needle for this purpose.

14. The method as claimed in claim 9, wherein the at least one predetermined lift of the nozzle needle is set for the second module and a second characteristic variable is determined as a function of a resulting throughflow of fluid through an injection nozzle of the nozzle body, with test fluid being supplied at a predetermined pressure.

15. The method as claimed in claim 9, wherein at least one predetermined lift of the nozzle needle is set for the second module and a predetermined throughflow of test fluid through the injection nozzle of the nozzle body is set and a third characteristic variable is determined as a function of the necessary pressure of the test fluid for this purpose.

16. The method as claimed in claim 8, wherein the first module comprises an injector housing.

17. The method as claimed in claim 8, wherein the first module comprises an injector housing.

18. A method for producing an injector, comprising the steps of:

assembling a first module comprising an injector housing and a lift actuating drive, assembling a second module comprising a nozzle body, a nozzle needle and a reset means for the nozzle needle, determining at least one value of at least one characteristic variable for the first module by appropriate activation of the lift actuating drive, assigning the first module to one of a number of classes as a function of the at least one value of the at least one characteristic variable, determining at least one value of at least one characteristic variable for the second module by appropriate actuation of the nozzle needle, assigning the second module to one of a number of classes as a function of the at least one value of the at least one characteristic variable, and pairing and assembling a first module with a second module of the same class, respectively, wherein a predetermined lift of the lift actuating drive is set for the first module with a predetermined electrical energy being supplied and the counter-force required on the lift actuating drive for this purpose is determined as the characteristic variable.

19. A method for producing an injector, comprising the steps of:

assembling a first module comprising a lift actuating drive, assembling a second module comprising a nozzle arrangement, determining at least one value of at least one characteristic variable for the first module by appropriate activation of the lift actuating drive, assigning the first module to one of a number of classes as a function of the at least one value of the at least one characteristic variable, determining at least one value of at least one characteristic variable for the second module by appropriate actuation of the nozzle arrangement, assigning the second module to one of a number of classes as a function of the at least one value of the at least one characteristic variable, and pairing and assembling a first module with a second module of the same class, respectively, wherein a predetermined lift of the lift actuating drive is set for the first module with a predetermined electrical energy being supplied and the counter-force required on the lift actuating drive for this purpose is determined as the characteristic variable.

20. The method as claimed in claim 19, wherein the nozzle arrangement comprises a nozzle body, a nozzle needle and a reset means for the nozzle needle.

* * * * *